US012241670B2

(12) United States Patent
Legay et al.

(10) Patent No.: US 12,241,670 B2
(45) Date of Patent: Mar. 4, 2025

(54) MULTI-COMPRESSOR SYSTEM WITH NORMALLY-OPEN VALVES IN OIL BALANCING CONNECTIONS

(71) Applicant: Danfoss Commercial Compressors, Trevoux (FR)

(72) Inventors: Thierry Legay, Nordborg (DK); Patrice Bonnefoi, Nordborg (DK)

(73) Assignee: DANFOSS COMMERCIAL COMPRESSORS, Trevoux (FR)

( * ) Notice: Subject to any disclaimer, the term of this patent is extended or adjusted under 35 U.S.C. 154(b) by 183 days.

(21) Appl. No.: 18/182,764

(22) Filed: Mar. 13, 2023

(65) Prior Publication Data

US 2023/0314048 A1 Oct. 5, 2023

(30) Foreign Application Priority Data

Mar. 31, 2022 (FR) ..... 22/02955

(51) Int. Cl.

| | |
|---|---|
| ***F25B 7/00*** | (2006.01) |
| ***F04B 41/06*** | (2006.01) |
| ***F04C 2/02*** | (2006.01) |
| ***F04C 11/00*** | (2006.01) |

(Continued)

(52) U.S. Cl.

CPC ..... *F25B 7/00* (2013.01); *F04B 41/06* (2013.01); *F04C 2/025* (2013.01); *F04C 11/001* (2013.01); *F25B 31/004* (2013.01); *F25B 41/20* (2021.01)

(58) Field of Classification Search

CPC ..... F25B 7/00; F25B 31/004; F25B 31/00; F25B 2400/075; F25B 1/00; F04B 41/06; F04B 41/20; F04B 41/42; F04B 39/023; F04C 2/025; F04C 11/001; F04C 2240/806; F04C 2270/24; F04C 23/001;

(Continued)

(56) References Cited

U.S. PATENT DOCUMENTS

| | | | |
|---|---|---|---|
| 6,123,528 A | 9/2000 | Sun et al. | |
| 10,641,268 B2 | 5/2020 | Brostrom et al. | |

(Continued)

FOREIGN PATENT DOCUMENTS

| | | | | |
|---|---|---|---|---|
| CN | 101451757 A | * | 6/2009 | |
| CN | 107923403 A | * | 4/2018 | ..... F04C 23/001 |
| CN | 108369037 A | * | 8/2018 | ..... F25B 1/00 |

(Continued)

*Primary Examiner* — Emmanuel E Duke

(74) *Attorney, Agent, or Firm* — McCormick, Paulding & Huber PLLC

(57) ABSTRACT

The multi-compressor system has a plurality of parallelly coupled compressors; inlet connection lines each connected to a refrigerant suction fitting of a respective compressor; outlet connection lines each connected to a refrigerant discharge fitting of a respective compressor; a common oil balancing line and balancing connection lines each connecting the common oil balancing line to an oil balancing connection of a respective compressor; and spring-loaded normally-open valves each being arranged within a respective balancing connection line or within an oil balancing connection of a respective compressor and each being configured to close when a pressure difference between a pressure prevailing in the low pressure volume of the respective compressor and a pressure prevailing in the common oil balancing line reaches a predetermined value.

18 Claims, 6 Drawing Sheets

(51) Int. Cl.
*F25B 31/00* (2006.01)
*F25B 41/20* (2021.01)

(58) Field of Classification Search
CPC .. F04C 23/008; F04C 29/028; F04C 18/0207;
F04C 28/065; F16K 1/20; F16K 1/32
See application file for complete search history.

(56) References Cited

U.S. PATENT DOCUMENTS

| | | | |
|---|---|---|---|
| 2007/0237664 | A1 | 10/2007 | Joo et al. |
| 2013/0020520 | A1 | 1/2013 | Scaramucci |

FOREIGN PATENT DOCUMENTS

| | | | |
|---|---|---|---|
| CN | 210035940 | U | 2/2020 |
| EP | 1 443 286 | A1 | 8/2004 |
| FR | 2 966 569 | A1 | 4/2012 |
| WO | WO-2021169213 | A1 * | 9/2021 |

* cited by examiner

MULTI-COMPRESSOR SYSTEM WITH NORMALLY-OPEN VALVES IN OIL BALANCING CONNECTIONS

CROSS-REFERENCE TO RELATED APPLICATION

This application claims foreign priority benefits under 35 U.S.C. § 119 from French Patent Application No. 22/02955, filed Mar. 31, 2022, the content of which is hereby incorporated by reference in its entirety.

TECHNICAL FIELD

The present invention relates to a multi-compressor system, and in particular to a multi-compressor refrigeration system.

BACKGROUND

As known, a refrigeration system comprises a refrigerant circulation circuit successively including a condenser, an expansion device, an evaporator and a multi-compressor system connected in series, the multi-compressor system, also named manifolded compressor system, comprising:

- a plurality of compressors which are parallelly coupled, the plurality of compressors comprising at least two compressors, each compressor including a compressor shell provided with a refrigerant suction fitting, a refrigerant discharge fitting and an oil balancing connection,
- a common suction line and inlet connection lines each connecting the common suction line to the refrigerant suction fitting of a respective compressor,
- a common discharge line and outlet connection lines each connecting the common discharge line to the refrigerant discharge fitting of a respective compressor,
- a common oil balancing line and balancing connection lines each connecting the common oil balancing line to the oil balancing connection of a respective compressor, and
- a controller configured to control operation of the multi-compressor system.

When such a multi-compressor system operates with at least one compressor that is off, i.e. not operating, while at least two compressors are running, pressure in the low pressure volume of the stopped compressor increases considerably and is higher than that of the running compressors, which causes refrigerant gas to flow from the stopped compressor towards the running compressors through the balancing connection line connected to the stopped compressor and through the common oil balancing line.

Such a gas bypass flow, in the balancing connection line connected to the stopped compressor and in the common oil balancing line, may prevent oil from leaving a running compressor trough the respective balancing connection line. Therefore, no oil exchange between the two running compressors would be possible, which could lead to low oil level in one of the running compressors and excessive oil level in the other running compressor. Similar situations may occur, when two compressors are stopped in a multi-compressor system comprising four compressors.

In systems with only two compressors, the increased pressure in the low pressure volume of a stopped compressor will both create a bypass flow of refrigeration gas and flow of oil from the oil sump of the stopped compressor towards the running compressor. Hence there is a risk of loss of oil in the stopped compressor and a risk of increased oil circulation rate (OCR) due to excessive amount of oil in the running compressor. Similar situations may occur in multi-compressor systems comprising three, four or even more compressors, when only a single compressor is operating.

When a compressor, having suffered from a significant oil level drop, is subsequently restarted, the quantity of oil contained in the oil sump thereof may not be sufficient to ensure suitable lubrication of the different moving parts of said compressor, which may damage the integrity of said compressor and thus the relatability of the above-mentioned multi-compressor system.

U.S. Ser. No. 10/641,268 discloses a multi-compressor system of the aforementioned type in which solenoid valves are respectively arranged in the balancing connection lines, each solenoid valve being configured to isolate low pressure volume of the respective compressor from the common oil balancing line based on a control signal emitted by a controller, which receives signals from individual oil level detectors each located in a respective compressor.

CN210035940U shows a similar multi-compressor system with solenoid valves each arranged in a respective balancing connection line, each solenoid valve being opened or closed depending on the operating or stopped status of the respective compressor.

Such a configuration of the multi-compressor systems disclosed in U.S. Ser. No. 10/641,268 or CN210035940U prevents bypass flows of suction gas from an idle compressor is prevented, and thus ensures good equalization of oil level within the oil sumps of operating compressors.

However, such actively controlled types of valves, including their mounting and wiring, leads to increased costs for the multi-compressor system.

SUMMARY

It is an object of the present invention to provide an improved multi-compressor system which can overcome the drawbacks encountered in conventional multi-compressor systems.

Particularly, an object of the present invention is to provide a multi-compressor system with good oil balancing properties at reduced costs.

According to the invention such a multi-compressor system comprises:

- a plurality of compressors which are parallelly coupled, the plurality of compressors comprising at least two compressors, each compressor including a compressor shell provided with a refrigerant suction fitting, a refrigerant discharge fitting and an oil balancing connection, each oil balancing connection being fluidly connected to a low pressure volume of the respective compressor, and particularly to an oil sump of the respective compressor,
- a common suction line and inlet connection lines each connecting the common suction line to the refrigerant suction fitting of a respective compressor,
- a common discharge line and outlet connection lines each connecting the common discharge line to the refrigerant discharge fitting of a respective compressor,
- a common oil balancing line and balancing connection lines each connecting the common oil balancing line to the oil balancing connection of a respective compressor, and
- a plurality of spring-loaded normally-open valves each associated with a respective compressor, each spring-loaded normally-open valve being configured to occupy an open configuration in which said spring-loaded normally-open valve fluidly connects the low pressure volume of the respective compressor with the common oil balancing line and a closed configuration in which said spring-loaded normally-open valve at least partially fluidly isolates the low pressure volume of the respective compressor from the common oil balancing line, each spring-loaded normally-open valve being configured to be displaced in the closed configuration when a pressure difference between a pressure prevailing in the low pressure volume of the respective compressor and a pressure prevailing in the common oil balancing line reaches a predetermined value.

During part-load operation of such a multi-compressor system, at least one compressor is stopped and the pressure within the low pressure volume of said compressor will rise. When a pressure difference between a pressure prevailing in the low pressure volume of said non-operating compressor and a pressure prevailing in the common oil balancing line reaches the predetermined value, the respective spring-loaded normally-open valve closes (i.e. is displaced in the closed configuration) and at least partially fluidly isolates the non-operating compressor from the common oil balancing line.

Hereby, a creation of bypass flows of suction gas through the balancing connection line connected to said non-operating compressor is prevented, and good equalization of oil level within the oil sumps of operating compressors (when the plurality of compressors comprises three or more compressors) is assured, without using actively controlled valves.

Therefore, the multi-compressor system according to the present invention ensures good oil balancing properties at reduced costs.

In addition, prevention of this bypass flow from an idle compressor decreases actual superheat seen by the running compressor(s). Indeed, without the spring-loaded normally-open valves, the suction gas crossing the idle compressor heats the respective balancing connection line, which results in an increase of actual superheat seen by the running compressor(s). Reduction of actual suction superheat, due to the presence of the spring-loaded normally-open valves, causes a reduction of the discharge temperature of the compressed refrigerant and thus maximizes operating envelope of the multi-compressor system.

Prevention of this bypass flow from an idle compressor also reduces oil dilution in said idle compressor.

Moreover, when the plurality of compressors comprises only two compressors, an oil flow from the oil sump of the stopped compressor towards the running compressor is prevented. Hence, a risk of loss of oil in the stopped compressor and a risk of increased oil circulation rate (OCR) due to excessive amount of oil in the running compressor are prevented.

The multi-compressor system may also include one or more of the following features, taken alone or in combination.

According to an embodiment of the invention, each spring-loaded normally-open valve is configured to be displaced in the closed configuration when the respective compressor is off while at least one of the other compressors is running.

According to an embodiment of the invention, each spring-loaded normally-open valve is configured to be displaced in the open configuration when the respective compressor is running.

According to an embodiment of the invention, each spring-loaded normally-open valve is arranged within a respective balancing connection line or within an oil balancing connection of a respective compressor.

According to an embodiment of the invention, the predetermined value is between 5 and 15 mbar, and for example around 10 mbar.

According to an embodiment of the invention, each oil balancing connection includes an oil sump port provided on the compressor shell of the respective compressor and an oil balancing fitting connected to the respective oil sump port, each balancing connection line being connected to a respective oil balancing fitting.

According to an embodiment of the invention, at least one of the spring-loaded normally-open valve is arranged within, i.e. is inserted in, the oil sump port of the respective compressor.

According to an embodiment of the invention, at least one of the spring-loaded normally-open valve is arranged within, i.e. is inserted in, the oil balancing fitting of the respective compressor.

According to an embodiment of the invention, each oil balancing fitting includes a first fitting end portion connected to the respective oil sump port and a second fitting end portion located away from the respective oil sump port.

According to an embodiment of the invention, at least one of the spring-loaded normally-open valve is arranged at the second fitting end portion of the oil balancing fitting of the respective compressor.

According to an embodiment of the invention, at least one of the spring-loaded normally-open valve is arranged outside the compressor shell of the respective compressor.

According to an embodiment of the invention, at least one of the balancing connection line includes a first tubular connecting part connected to the common oil balancing line, and a second tubular connecting part connected to the oil balancing connection of a respective compressor, the respective spring-loaded normally-open valve being interposed between said first and second tubular connecting parts.

According to an embodiment of the invention, each spring-loaded normally-open valve includes:

- a fluid flow passage,
- a valve seat surrounding the respective fluid flow passage, and
- a valve member movable between a closed position in which the valve member bears against the respective valve seat and at least partially closes the respective fluid flow passage and an open position in which the valve member is remote from the respective valve seat and clears the respective fluid flow passage.

According to an embodiment of the invention, the fluid flow passage of each spring-loaded normally-open valve is configured to fluidly connect the low pressure volume of the respective compressor with the common oil balancing line.

According to an embodiment of the invention, each valve member is configured to be moved in the closed position when a pressure difference between a pressure prevailing in the low pressure volume of the respective compressor and a pressure prevailing in the common oil balancing line reaches a predetermined value.

According to an embodiment of the invention, each valve member includes an oil passage hole configured to avoid an excessive oil accumulation within an oil sump of the respective compressor when said compressor is off.

According to an embodiment of the invention, each oil passage hole is arranged in a lower portion of the respective valve member.

According to an embodiment of the invention, each valve member has a disc shape.

According to an embodiment of the invention, each spring-loaded normally-open valve further includes a mounting part provided with the respective valve seat and attached to the respective balancing connection line or to the respective oil balancing connection.

According to an embodiment of the invention, each mounting part is annular.

According to an embodiment of the invention, each valve member is pivotally mounted around a pivot axis, which may extend substantially horizontally.

According to an embodiment of the invention, each spring-loaded normally-open valve further includes a support shaft configured to support the respective valve member and to which is non-rotatably secured the respective valve member, said support shaft being pivotally mounted to the respective mounting part around the respective pivot axis.

According to an embodiment of the invention, each spring-loaded normally-open valve further includes a spring member, such as a torsion spring, configured to bias the respective valve member towards its open position.

According to an embodiment of the invention, each spring member includes a first end part, such as a first end branch, configured to cooperate with the respective mounting part and a second end part, such as a second end branch, configured to cooperate with the respective valve member, and particularly with a first face of the respective valve member oriented towards the respective valve seat.

According to an embodiment of the invention, each spring member further includes an intermediate portion surrounding the respective support shaft.

According to an embodiment of the invention, each mounting part includes a fixing notch in which is received the first end part of the respective spring member.

According to another embodiment of the invention, each valve member is slidably mounted along a displacement direction. Advantageously, each spring-loaded normally-open valve includes at least one guiding member, for example a guiding rod, configured to guide the respective valve member between its open and closed positions.

According to an embodiment of the invention, the multi-compressor system includes a controller configured to control operation of the multi-compressor system, the controller being configured to operate the multi-compressor system according to a plurality of predetermined operating configurations.

According to an embodiment of the invention, the plurality of predetermined operating configurations includes part-load operation configurations where at least one of the compressors is stopped while all the other compressors of the plurality of compressors are running.

According to an embodiment of the invention, each predetermined operating configuration is configured to result in a predetermined output capacity for the multi-compressor system.

According to an embodiment of the invention, the controller is configured to control the plurality of compressors in response to a required output capacity for the multi-compressor system.

According to an embodiment of the invention, the controller is configured to select a predetermined operating configuration, among the plurality of predetermined operating configurations, that corresponds to the required output capacity for the multi-compressor system.

According to an embodiment of the invention, the plurality of predetermined operating configurations includes a full-load operation configuration where all the compressors of the plurality of compressors are running.

According to an embodiment of the invention, each compressor comprises a single oil balancing connection.

According to an embodiment of the invention, each balancing connection line includes a tubular connecting part including a first end portion connected to the common oil balancing line connection and a second end portion connected to an oil balancing connection of a respective compressor.

According to an embodiment of the invention, the mounting part of at least one spring-loaded normally-open valve is configured to bear against an axial end surface of the respective oil balancing fitting.

According to an embodiment of the invention, the mounting part of at least one spring-loaded normally-open valve is configured to bear against an axial end surface of the second end portion of a respective tubular connecting part.

According to an embodiment of the invention, each compressor of the plurality of compressors is a scroll compressor.

According to an embodiment of the invention, each of said compressors includes an oil sump located at a lower portion of the respective compressor shell.

According to an embodiment of the invention, the inlet connection lines have identical or similar dimensions. In the present document, "similar dimensions" means that a ratio of any dimension of an inlet connection line to the corresponding dimension of any other inlet connection line is between 0.8 and 1.2, and advantageously between 0.9 and 1.1.

According to an embodiment of the invention, each compressor of the plurality of compressors has a variable capacity, and for example includes an electric motor having a variable speed.

According to an embodiment of the invention, each compressor of the plurality of compressors has a fixed capacity, and for example includes an electric motor having a fixed speed.

According to an embodiment of the invention, the plurality of compressors comprise both variable capacity compressors and fixed capacity compressors.

According to an embodiment of the invention, all of the oil balancing connections are approximately at the same vertical elevation with respect to a bottom of the respective compressor shell. Said configuration ensures proper equalization of the oil levels in the plurality of compressors.

According to an embodiment of the invention, the second end portion of each tubular connecting part includes an axial end face which is substantially recessed from an inner surface of the compressor shell of the respective compressor.

According to an embodiment of the invention, the plurality of compressors comprises at least three compressors.

According to an embodiment of the invention, the plurality of compressors comprises at least four compressors.

The present invention also relates to a refrigeration system comprising a refrigerant circulation circuit successively including a condenser, an expansion device, an evaporator and a multi-compressor system according to the present invention connected in series.

BRIEF DESCRIPTION OF THE DRAWINGS

The following detailed description of three embodiments of the invention is better understood when read in conjunction with the appended drawings being understood, however, that the invention is not limited to the specific embodiments disclosed.

DETAILED DESCRIPTION

Figure 1:
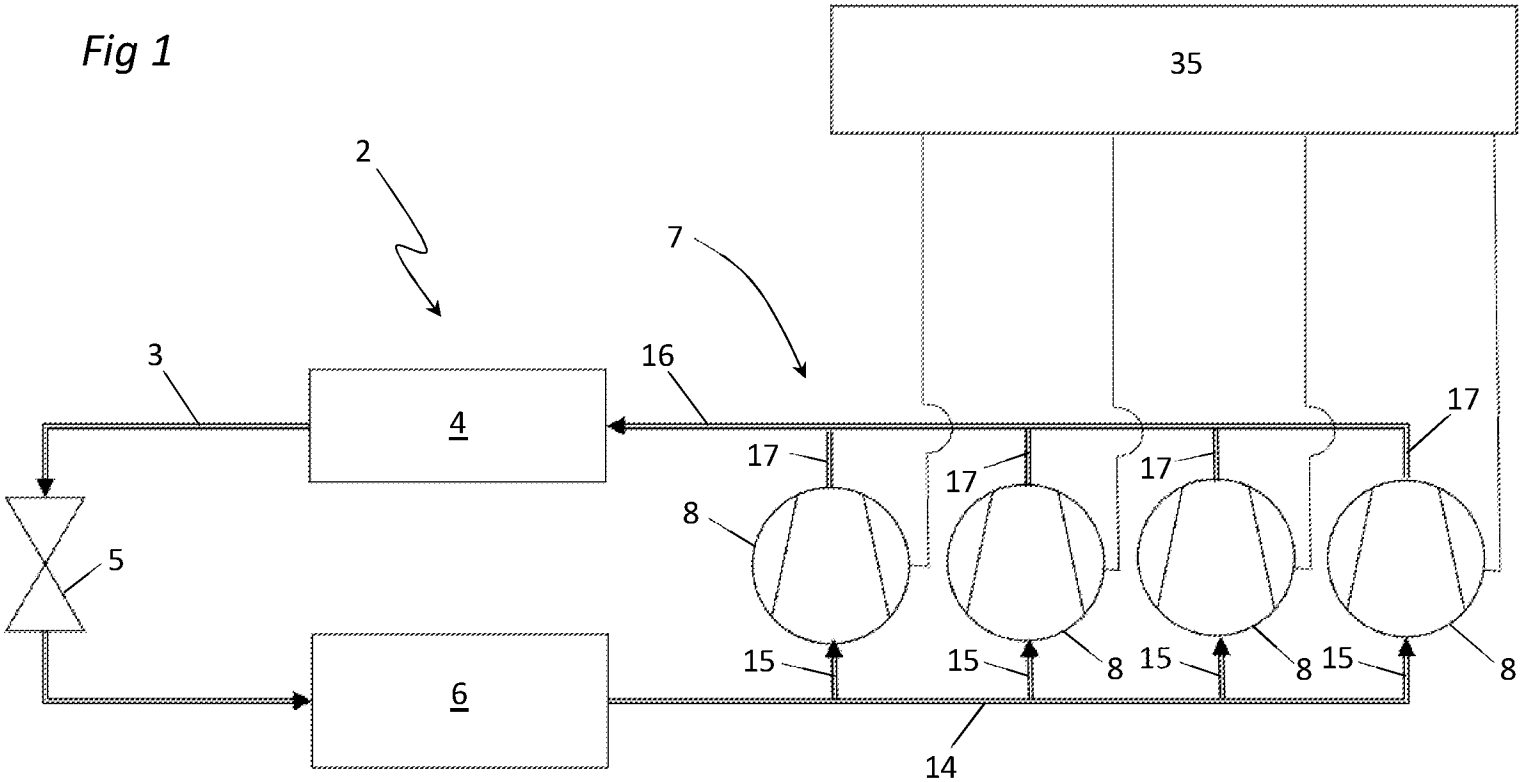
FIG. 1 is a diagrammatic view of a refrigeration system including a multi-compressor system according to a first embodiment of the invention.

FIG. 1 describes a refrigeration system 2 comprising a refrigerant circulation circuit 3 successively including a condenser 4, an expansion device 5, an evaporator 6 and a multi-compressor system 7 connected in series.

The multi-compressor system 7 includes a plurality of compressors 8 which are parallelly coupled. The plurality of compressors comprises at least three compressors 8, and for example four compressors 8.

Each compressor 8 includes a compressor shell 9 provided with a refrigerant suction fitting 11 configured to supply the respective compressor 8 with refrigerant gas to be compressed and a refrigerant discharge fitting 12 configured to discharge compressed refrigerant gas.

Advantageously, each compressor 8 is a scroll compressor, and includes a compression unit (not shown on the figures) disposed inside the respective compressor shell 9 and configured to compress the refrigerant gas supplied by the respective refrigerant suction fitting 11. Each compression unit includes a fixed scroll, which is fixed in relation to the respective compressor shell 9, and an orbiting scroll configured to perform an orbiting movement relative to the respective fixed scroll during operation of the respective compressor 8.

Furthermore, each compressor 8 includes a drive shaft (not shown on the figures) which is vertically orientated and which is configured to drive the respective orbiting scroll in an orbital movement, and an electric motor (not shown on the figures) arranged within the respective compressor shell 9 and coupled to the respective drive shaft so as to drive in rotation the respective drive shaft about a rotation axis. Each compressor 8 of the plurality of compressors may have a variable capacity, and may for example include an electric motor having a variable speed. However, each compressor 8 of the plurality of compressors may have a fixed capacity, and for example may include an electric motor having a fixed speed.

Each compressor 8 also includes an oil sump 13 located at a lower portion of the respective compressor shell 9.

Figure 2:
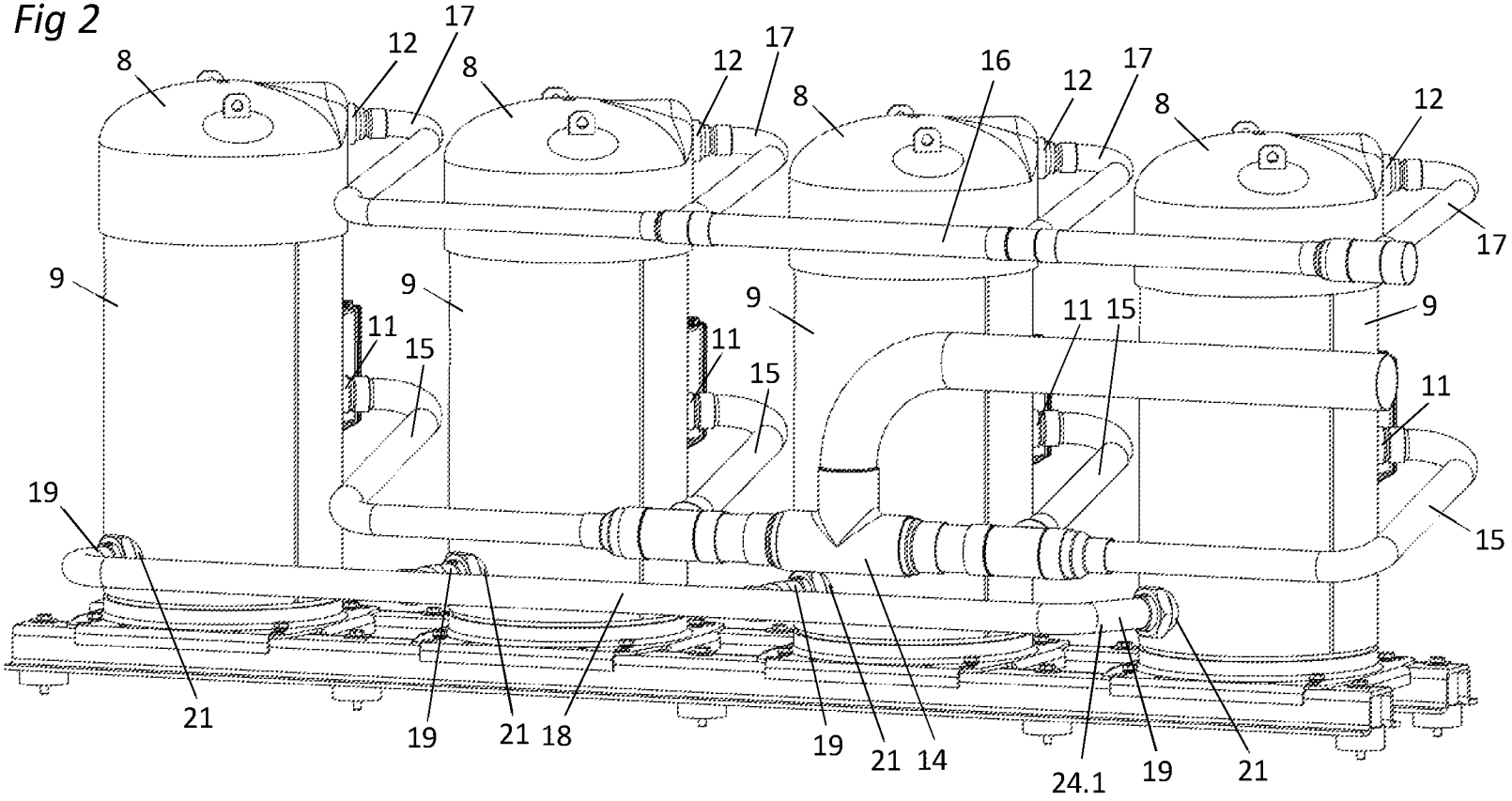
FIG. 2 is a perspective view of the multi-compressor system of FIG. 1.
Figure 3:
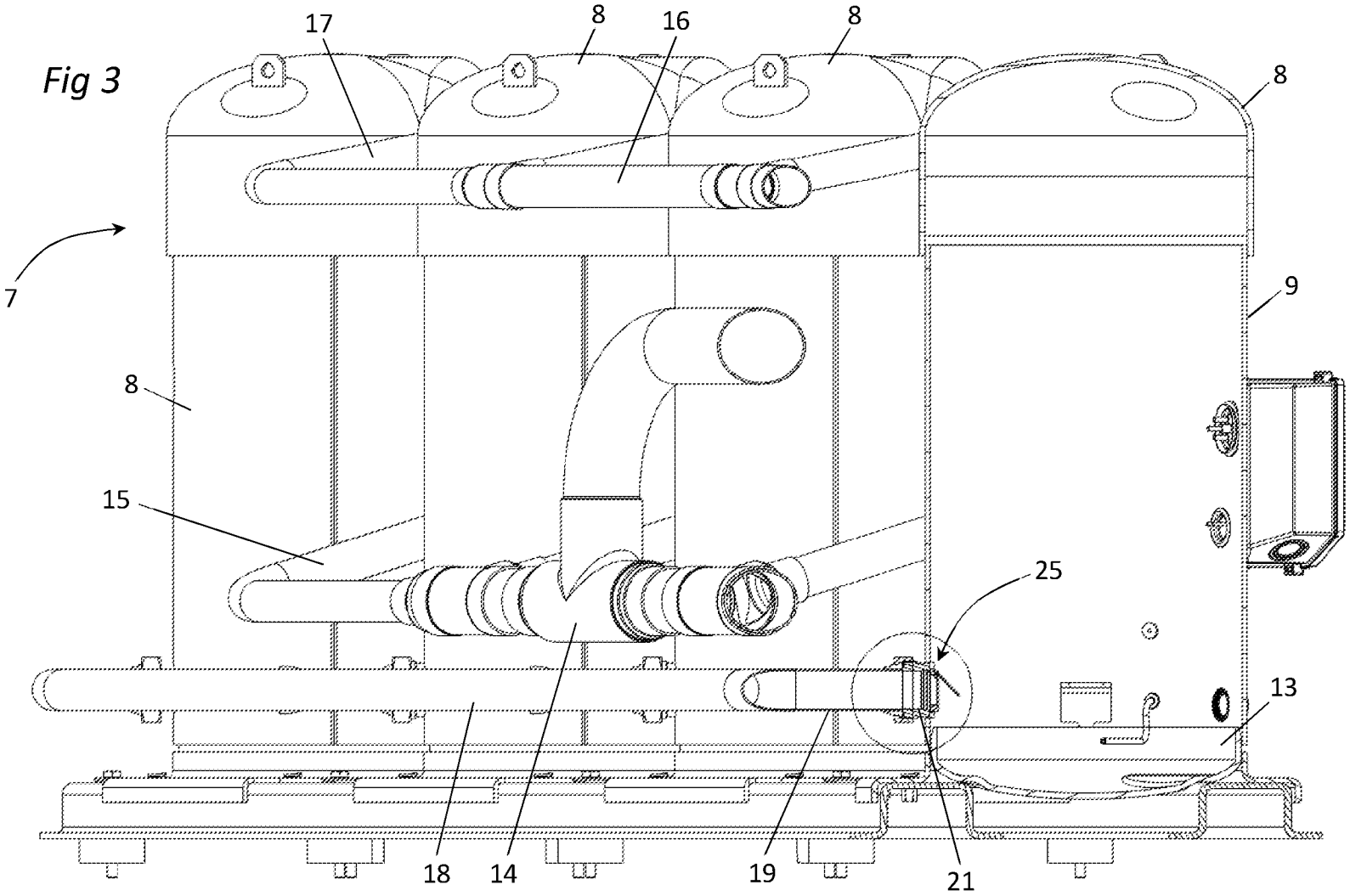
FIG. 3 is perspective view of the multi-compressor system of FIG. 1 in which one compressor is sectioned along a section plan extending through a respective oil sump port.

The multi-compressor system 7 further includes a common suction line 14 and inlet connection lines 15 each connecting the common suction line 14 to the refrigerant suction fitting 11 of a respective compressor 8. As shown on FIG. 2, the inlet connection lines 15 have identical dimensions and may have identical flow restrictions. Advantageously, the inlet connection lines 15 are substantially identical and extend horizontally.

The multi-compressor system 7 also includes a common discharge line 16 and outlet connection lines 17 each connecting the common discharge line 16 to the refrigerant discharge fitting 12 of a respective compressor 8. As shown on FIG. 2, the outlet connection lines 17 have identical dimensions. Advantageously, the outlet connection lines 17 are substantially identical and extend horizontally.

Furthermore, the multi-compressor system 7 includes a common oil balancing line 18 and balancing connection lines 19, also named balancing branch lines, each connecting the common oil balancing line 18 to an oil balancing connection 21 provided on the compressor shell 9 of a respective compressor 8. The common oil balancing line 18 and the balancing connection lines 19 are particularly configured to fluidly connect low pressure volumes of the compressors 8, and particularly the oil sumps 13 of said compressors 8, and thus to allow oil to flow between the compressors 8 and to balance the oil levels within the compressors 8. Advantageously, the common oil balancing line 18 and the balancing connection lines 19 extend horizontally, and all of the oil balancing connections 21 are approximately at the same vertical elevation with respect to a bottom of the respective compressor shell 9.

Figure 4:
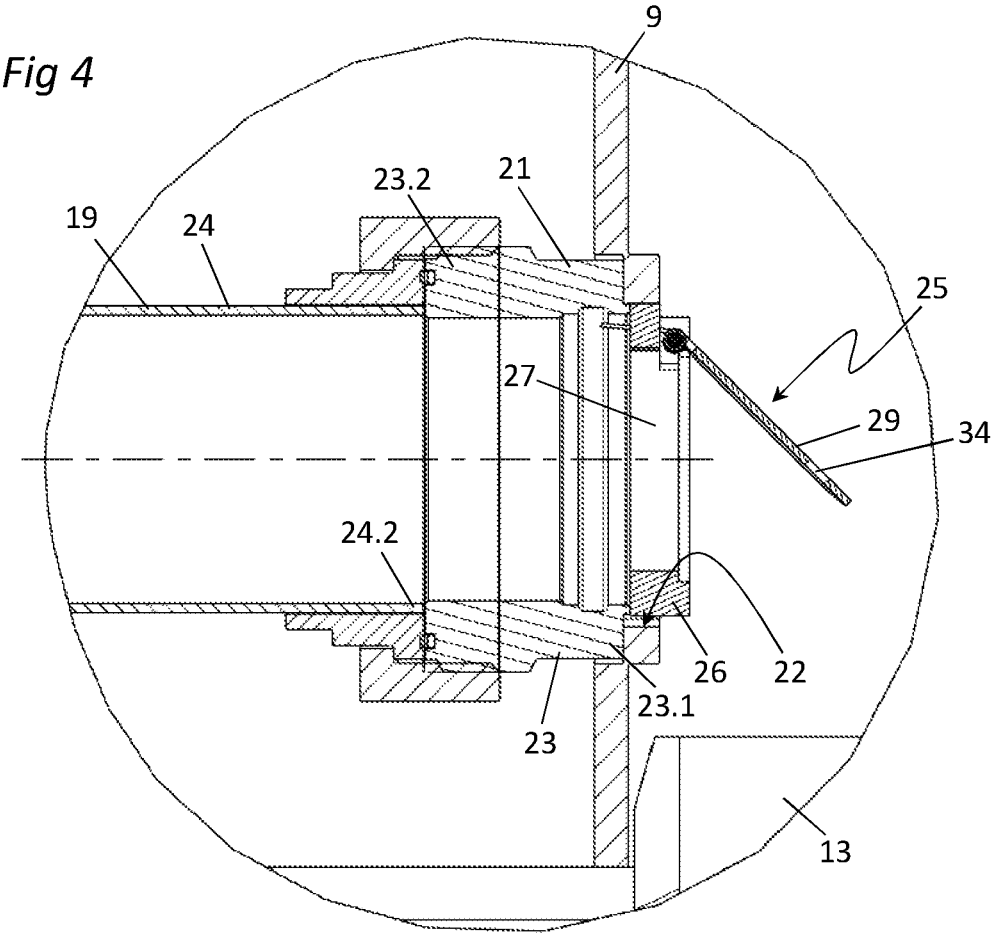
FIG. 4 is an enlarged view of a detail of FIG. 3.
Figure 5:
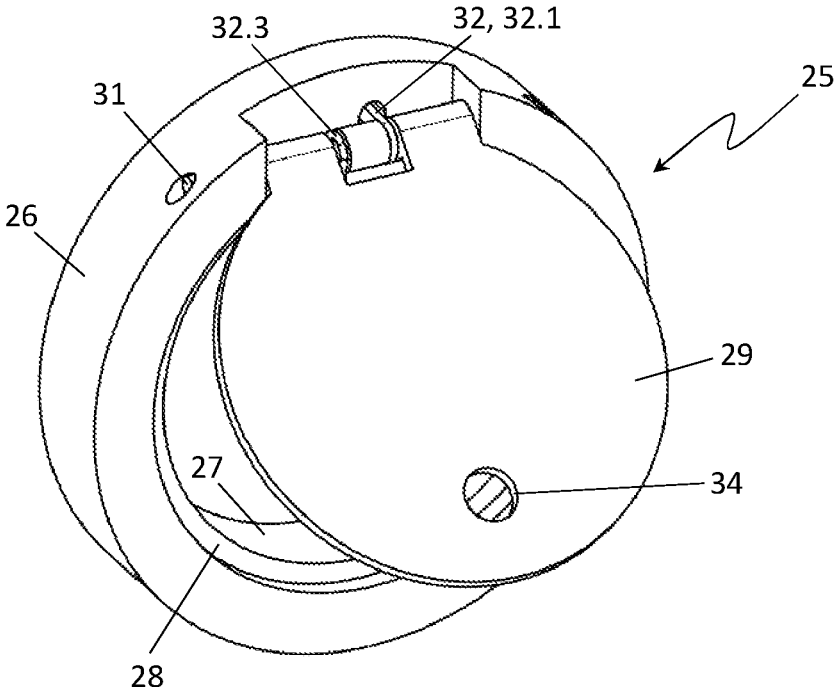
FIG. 5 is a front perspective view of a spring-loaded normally-open valve of the multi-compressor system of FIG. 1.
Figure 6:
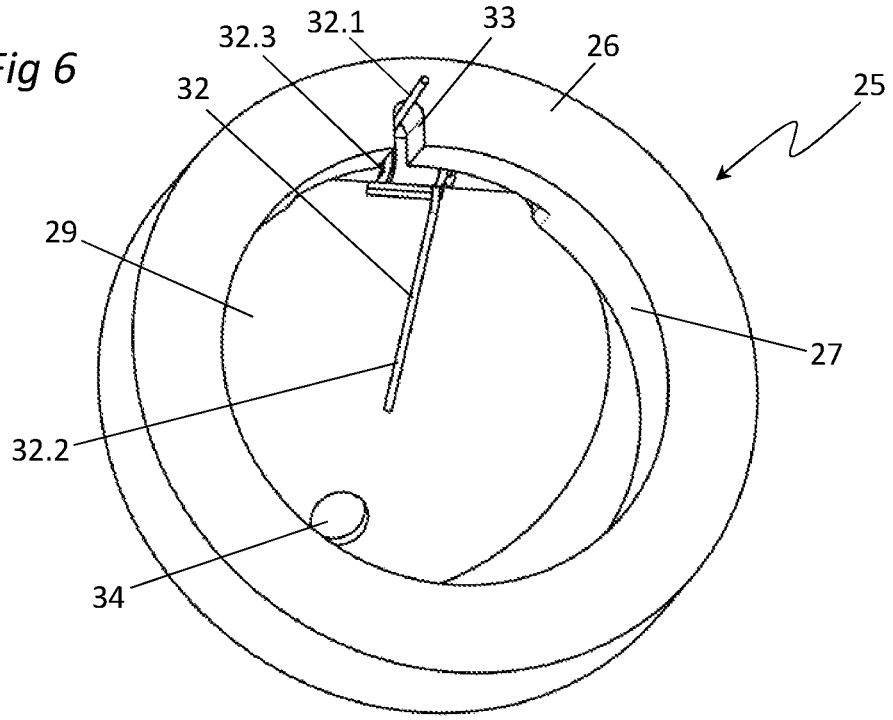
FIG. 6 is a rear perspective view of the spring-loaded normally-open valve of FIG. 5.
Figure 7:
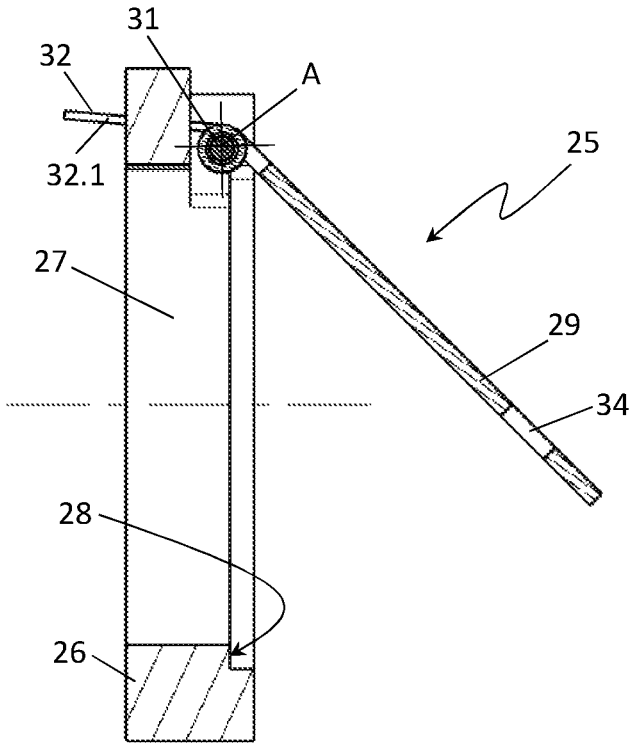
FIG. 7 is a cross section view of the spring-loaded normally-open valve of FIG. 5.

As better shown on FIG. 4, each oil balancing connection 21 includes an oil sump port 22 provided on the compressor shell 9 of the respective compressor 8, and an oil balancing fitting 23 connected to the respective oil sump port 22 and to which is connected the respective balancing connection line 19. Each oil balancing fitting 23 is tubular and includes a first fitting end portion 23.1 connected to the respective oil sump port 22 and a second fitting end portion 23.2 located away from the respective oil sump port 22.

According to the embodiment shown on FIGS. 1 to 7, each balancing connection line 19 includes a tubular connecting part 24 including a first end portion 24.1 connected to the common oil balancing line 18 and a second end portion 24.2 connected to the respective oil balancing fitting 23.

The multi-compressor system 7 also includes spring-loaded normally-open valves 25 which are each arranged within an oil balancing connection 21 of a respective compressor 8. Each spring-loaded normally-open valve 25 is configured to open when the respective compressor 8 is running, such that the low pressure volume of the respective compressor 8 is fluidly connected to the common oil balancing line 18. Each spring-loaded normally-open valve 25 is configured to close when the respective compressor 8 is off while at least one of the other compressor 8 is running, such that the low pressure volume of the respective compressor 8 is at least partially fluidly isolated from the common oil balancing line 18 (in other words, the communication between the low pressure volume of the respective compressor 8 and the common oil balancing line 18 is cut off).

As better shown on FIGS. 4 to 7, each spring-loaded normally-open valve 25 includes a mounting part 26 attached to the respective oil balancing connection 21, and provided with a fluid flow passage 27 and a valve seat 28 surrounding the respective fluid flow passage 27. Advantageously, each mounting part 26 is annular.

According to the embodiment shown on FIGS. 1 to 7, the mounting part 26 of each spring-loaded normally-open valve 25 is inserted in the oil sump port 22 of the respective compressor 8, and is configured to bear against an axial end surface of the respective oil balancing fitting 23. The mounting part 26 of each spring-loaded normally-open valve 25 may be for example firmly fitted in the oil sump port 22 of the respective compressor 8.

Each spring-loaded normally-open valve 25 further includes a valve member 29 movable between a closed position in which the valve member 29 bears against the respective valve seat 28 and closes the respective fluid flow passage 27 and an open position in which the valve member 29 is remote from the respective valve seat 28 and clears the respective fluid flow passage 27. Each valve member 29 particularly includes a first face configured to be oriented towards the respective valve seat 28 and a second face opposite to the respective first face.

According to the embodiment shown on FIGS. 1 to 7, each valve member 29 has a disc shape, and is pivotally mounted around a pivot axis A which advantageously extends substantially horizontally.

Each spring-loaded normally-open valve 25 further includes a support shaft 31 configured to support the respective valve member 29 and to which is non-rotatably secured an upper portion of the respective valve member 29, said support shaft 31 being pivotally mounted to the respective mounting part 26 around the respective pivot axis A.

Each spring-loaded normally-open valve 25 also includes a spring member 32, such as a torsion spring, configured to bias the respective valve member 29 towards its open position.

According to the embodiment shown on FIGS. 1 to 7, each spring member 32 includes:

- a first end part 32.1, such as a first end branch, configured to cooperate with the respective mounting part 26,
- a second end part 32.2, such as a second end branch, configured to cooperate with the respective valve member 29, and particularly with the first face of the respective valve member 29 which is oriented towards the respective valve seat 28, and
- an intermediate portion 32.3 surrounding the respective support shaft 31.

According to the embodiment shown on FIGS. 1 to 7, each mounting part 26 advantageously includes a fixing notch 33 in which is received the first end part 32.1 of the respective spring member 32.

The valve member 29 of each spring-loaded normally-open valve 25 is particularly configured to be moved into its closed position when a pressure difference between a pressure prevailing in the low pressure volume of the respective compressor 8 and a pressure prevailing in the common oil balancing line 18 reaches a predetermined value which is between 5 and 15 mbar, and for example 10 mbar.

During part-load operation of the multi-compressor system 7, at least one compressor 8 is stopped (while the other compressors 8 are running) and the pressure within the low pressure volume of said compressor 8 will rise. When a pressure difference between a pressure prevailing in the low pressure volume of said non-operating compressor 8 and a pressure prevailing in the common oil balancing line 19 reaches the predetermined value, the pressure prevailing in the low pressure volume of said non-operating compressor 8 overcomes the opening force of the spring member 32 of the respective spring-loaded normally-open valve 25 such that the valve member 29 of said spring-loaded normally-open valve 25 is moved in its closed position and fluidly isolates the non-operating compressor from the common oil balancing line 18.

Hereby, a creation of bypass flows of suction gas through the balancing connection line 19 connected to said non-operating compressor 8 is prevented, and good equalization of oil level within the oil sumps 13 of operating compressors 8 is assured. Therefore, the multi-compressor system 7 according to the present invention ensures good oil balancing properties at reduced costs.

According to the embodiment shown on FIGS. 1 to 7, each valve member 29 includes an oil passage hole 34 arranged in a lower portion of the respective valve member 29. Such an oil passage hole 34 ensures an oil flow from the respective compressor 8 when said compressor 8 is off, and. Thus, the oil passage hole 34 provided on each valve member 29 is configured to avoid an excessive oil accumulation within the oil sump 13 of the respective compressor 8 when said compressor 8 is off.

The multi-compressor system 7 also includes a controller 35 configured to control operation of the multi-compressor system 7, i.e. to control operation (starting or stopping) of the plurality of compressors and particularly to control which compressor(s) 8 of the plurality of compressors is(are) in operation. The controller 35 may for example includes a microprocessor and a memory.

Particularly, the controller 35 is configured to operate the multi-compressor system 7 according to a plurality of predetermined operating configurations. The predetermined operation configurations comprise specific on/off configurations of said compressors 8 depending on the required load, i.e. the required output capacity. Advantageously, each predetermined operating configuration is configured to result in a predetermined output capacity for the multi-compressor system 7, and the controller 35 is configured to control the plurality of compressors in response to a required output capacity for the multi-compressor system 7. Particularly, the controller 35 is configured to select a predetermined operating configuration, among the plurality of predetermined operating configurations, that corresponds to the required output capacity for the multi-compressor system 7.

The plurality of predetermined operating configurations notably includes:

- part-load operation configurations where at least one of the compressors 8 is stopped while all the other compressors 8 of the plurality of compressors are running;
- part-load operation configurations where at least two compressors 8 are stopped while all the other compressors 8 of the plurality of compressors are running; and
- a full-load operation configuration where all the compressors 8 of the plurality of compressors are running.

Figure 8:
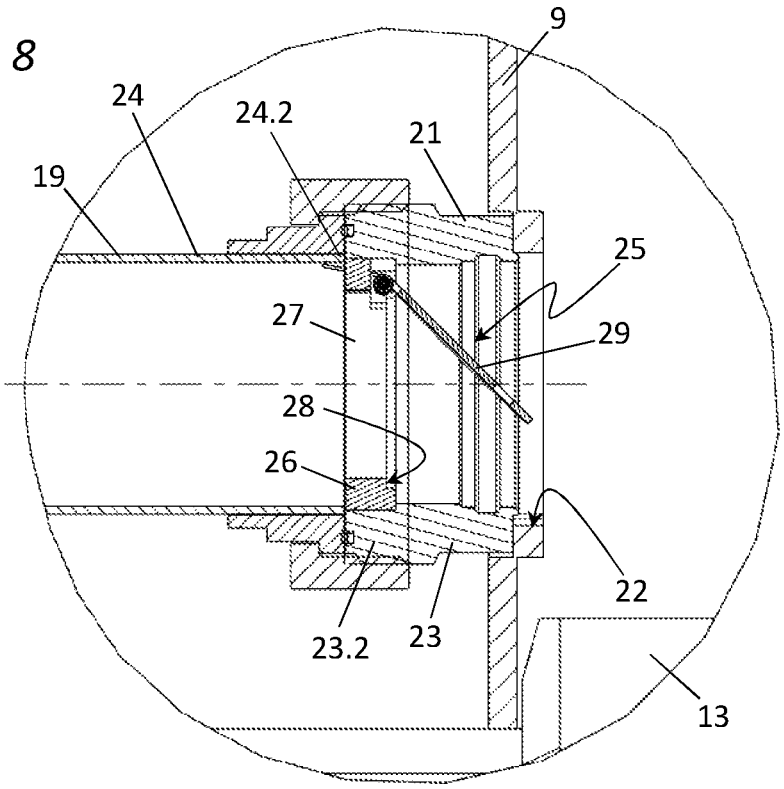
FIG. 8 is a partial cross section view of a multi-compressor system according to a second embodiment of the invention.

FIG. 8 represents a multi-compressor system 7 according to a second embodiment of the invention which differs from the embodiment shown on FIGS. 1 to 7 essentially in that the mounting part 26 of each spring-loaded normally-open valve 25 is arranged at the second fitting end portion 23.2 of the oil balancing fitting 23 of the respective compressor 8. Advantageously, the mounting part 26 of each spring-loaded normally-open valve 25 is configured to bear against an axial end surface of the second end portion 24.2 of the respective tubular connecting part 24.

Figure 9:
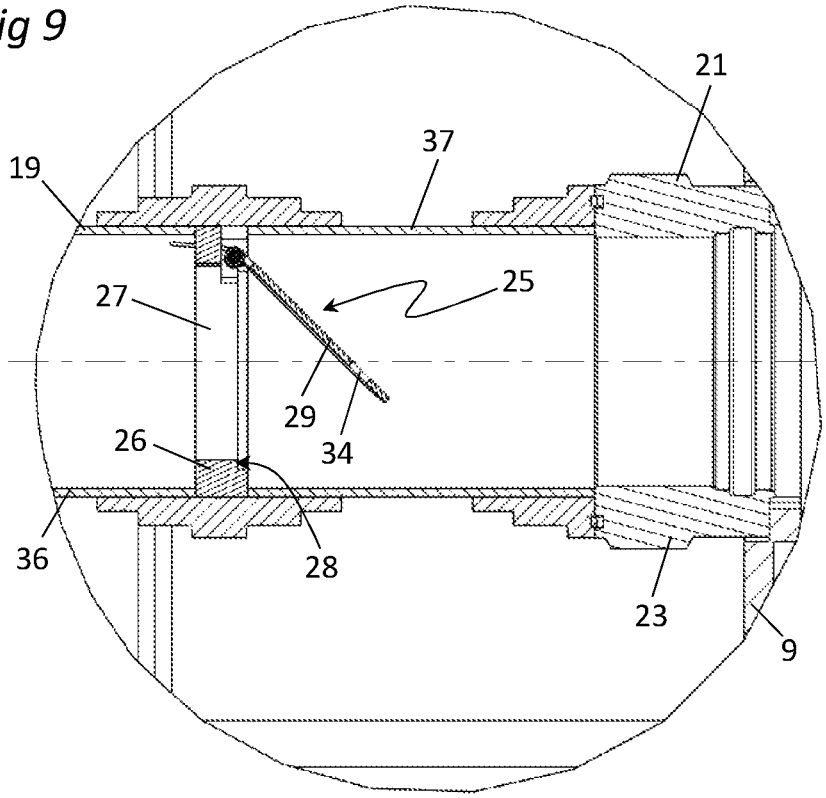
FIG. 9 is a partial cross section view of a multi-compressor system according to a third embodiment of the invention.

FIG. 9 represents a multi-compressor system 7 according to a third embodiment of the invention which differs from the embodiment shown on FIGS. 1 to 7 essentially in that each spring-loaded normally-open valve 25 is arranged outside the compressor shell 9 of the respective compressor 8, and particularly within a respective balancing connection line 19.

According to said third embodiment of the invention, each balancing connection line 19 includes a first tubular connecting part 36 connected to the common oil balancing line 18, and a second tubular connecting part 37 connected to the oil balancing connection 21 of a respective compressor 8, the mounting part 26 of the respective spring-loaded normally-open valve 25 being interposed between said first and second tubular connecting parts 36, 37.

According to another embodiment of the invention not shown on the figures, each valve member 29 may be slidably mounted along a displacement direction (for example substantially parallel to a central axis of the respective oil balancing connection 21) and between its open and closed positions. According to such an embodiment of the invention, each spring-loaded normally-open valve 25 may include at least one guiding member, for example a guiding rod, configured to guide the respective valve member 29 between its open and closed positions.

Of course, the invention is not restricted to the embodiments described above by way of non-limiting examples, but on the contrary it encompasses all embodiments thereof.

What is claimed is:

1. A multi-compressor system comprising:

a plurality of compressors which are parallelly coupled, the plurality of compressors comprising at least two compressors, each compressor including a compressor shell provided with a refrigerant suction fitting, a refrigerant discharge fitting and an oil balancing connection, each oil balancing connection being fluidly connected to a low pressure volume of the respective compressor, a common suction line and inlet connection lines each connecting the common suction line to the refrigerant suction fitting of a respective compressor, a common discharge line and outlet connection lines each connecting the common discharge line to the refrigerant discharge fitting of a respective compressor, a common oil balancing line and balancing connection lines each connecting the common oil balancing line to the oil balancing connection of a respective compressor, and a plurality of spring-loaded normally-open valves each associated with a respective compressor, each spring-loaded normally-open valve being configured to occupy an open configuration in which said spring-loaded normally-open valve fluidly connects the low pressure volume of the respective compressor with the common oil balancing line and a closed configuration in which said spring-loaded normally-open valve at least partially fluidly isolates the low pressure volume of the respective compressor from the common oil balancing line, each spring-loaded normally-open valve being configured to be displaced in the closed configuration when a pressure difference between a pressure prevailing in the low pressure volume of the respective compressor and a pressure prevailing in the common oil balancing line reaches a predetermined value.

2. The multi-compressor system according to claim 1, wherein the predetermined value is between 5 and 15 mbar.

3. The multi-compressor system according to claim 2, wherein each spring-loaded nor-mally-open valve is arranged within a respective balancing connection line or within an oil balancing connection of a respective compressor.

4. The multi-compressor system according to claim 2, wherein each oil balancing connection includes an oil sump port provided on the compressor shell of the respective compressor and an oil balancing fitting connected to the respective oil sump port, each balancing connection line being connected to a respective oil balancing fitting.

5. The multi-compressor system according to claim 1, wherein each spring-loaded normally-open valve is arranged within a respective balancing connection line or within an oil balancing connection of a respective compressor.

6. The multi-compressor system according to claim 5, wherein each oil balancing connection includes an oil sump port provided on the compressor shell of the respective compressor and an oil balancing fitting connected to the respective oil sump port, each balancing connection line being connected to a respective oil balancing fitting.

7. The multi-compressor system according to claim 1, wherein each oil balancing connection includes an oil sump port provided on the compressor shell of the respective compressor and an oil balancing fitting connected to the respective oil sump port, each balancing connection line being connected to a respective oil balancing fitting.

8. The multi-compressor system according to claim 7, wherein at least one of the spring-loaded normally-open valve is arranged within the oil sump port of the respective compressor.

9. The multi-compressor system according to claim 8, wherein at least one of the spring-loaded normally-open valve is arranged within the oil balancing fitting of the respective compressor.

10. The multi-compressor system according to claim 7, wherein at least one of the spring-loaded normally-open valve is arranged within the oil balancing fitting of the respective compressor.

11. The multi-compressor system according to claim 1, wherein at least one of the balancing connection line includes a first tubular connecting part connected to the common oil balancing line, and a second tubular connecting part connected to the oil balancing connection of a respective compressor, the respective spring-loaded normally-open valve being interposed between said first and second tubular connecting parts.

12. The multi-compressor system according to claim 1, wherein each spring-loaded normally-open valve includes:

a fluid flow passage, a valve seat surrounding the respective fluid flow passage, and a valve member movable between a closed position in which the valve member bears against the respective valve seat and at least partially closes the respective fluid flow passage and an open position in which the valve member is remote from the respective valve seat and clears the respective fluid flow passage.

13. The multi-compressor system according to claim 12, wherein each valve member includes an oil passage hole configured to avoid an excessive oil accumulation within an oil sump of the respective compressor when said compressor is off.

14. The multi-compressor system according to claim 13, wherein each oil passage hole is arranged in a lower portion of the respective valve member.

15. The multi-compressor system according to claim 12, wherein each spring-loaded normally-open valve further includes a mounting part provided with the respective valve seat and attached to the respective balancing connection line or to the respective oil balancing connection.

16. The multi-compressor system according to claim 12, wherein each valve member is pivotally mounted around a pivot axis.

17. The multi-compressor system according to claim 1, wherein each compressor of the plurality of compressors is a scroll compressor.

18. A refrigeration system comprising a refrigerant circulation circuit successively including a condenser, an expansion device, an evaporator and a multi-compressor system according to claim 1 connected in series.

* * * * *